United States Patent [19]

Lewis

[11] Patent Number: 4,506,889

[45] Date of Patent: Mar. 26, 1985

[54] PROTECTIVE DEVICE

[76] Inventor: John J. Lewis, 2439 Prospect, Evanston, Ill. 60201

[21] Appl. No.: 571,235

[22] Filed: Jan. 16, 1984

[51] Int. Cl.[3] ..... F41B 15/00

[52] U.S. Cl. ..... 273/84 R

[58] Field of Search ..... 273/84 R, 84 A; 272/8 R, 8 N, 27 R, 27 N; 119/153; 124/17, 18, 20, 79

[56] References Cited

U.S. PATENT DOCUMENTS

| | | | |
|---|---|---|---|
| 83,228 | 10/1868 | Warne | 273/84 R |
| 275,282 | 4/1883 | Stanton et al. | 272/27 N |
| 365,904 | 7/1887 | Bradish | 273/84 R |
| 375,485 | 12/1887 | Godward | 231/2 R |
| 442,470 | 12/1890 | Willeford | 273/84 R |
| 481,462 | 8/1892 | Benson | 145/61 R X |
| 1,909,932 | 5/1933 | Digel | 273/84 R |
| 2,168,132 | 8/1939 | Marshall | 119/153 |
| 2,499,511 | 3/1950 | Koger | 119/153 |
| 2,676,804 | 4/1954 | Schultz | 273/84 R |
| 3,071,127 | 1/1963 | Spack | 124/17 |
| 3,865,370 | 2/1975 | Rogers | 273/84 R |
| 3,944,226 | 3/1976 | Starrett | 273/84 R |
| 4,007,931 | 2/1977 | Wich et al. | 273/84 A |
| 4,034,982 | 7/1977 | Rupprecht et al. | 273/84 R |
| 4,070,023 | 1/1978 | Cutler | 273/84 A |
| 4,154,391 | 5/1979 | Girty | 231/3 |
| 4,283,051 | 8/1981 | Perez | 273/84 R |
| 4,456,256 | 6/1984 | Kleeger | 273/84 R |
| 4,460,174 | 7/1984 | Perry | 273/84 R |

*Primary Examiner*—William H. Grieb

*Attorney, Agent, or Firm*—John W. Harbst

[57] ABSTRACT

A hand held protective device including an elongated hollow handle, a closed looped member interlooped with one end of the handle and which is distendable therefrom by the user, and a releaseable closure arranged at the other end of the handle for withdrawing the loop into the housing upon completion of use.

23 Claims, 19 Drawing Figures

FIG. 1
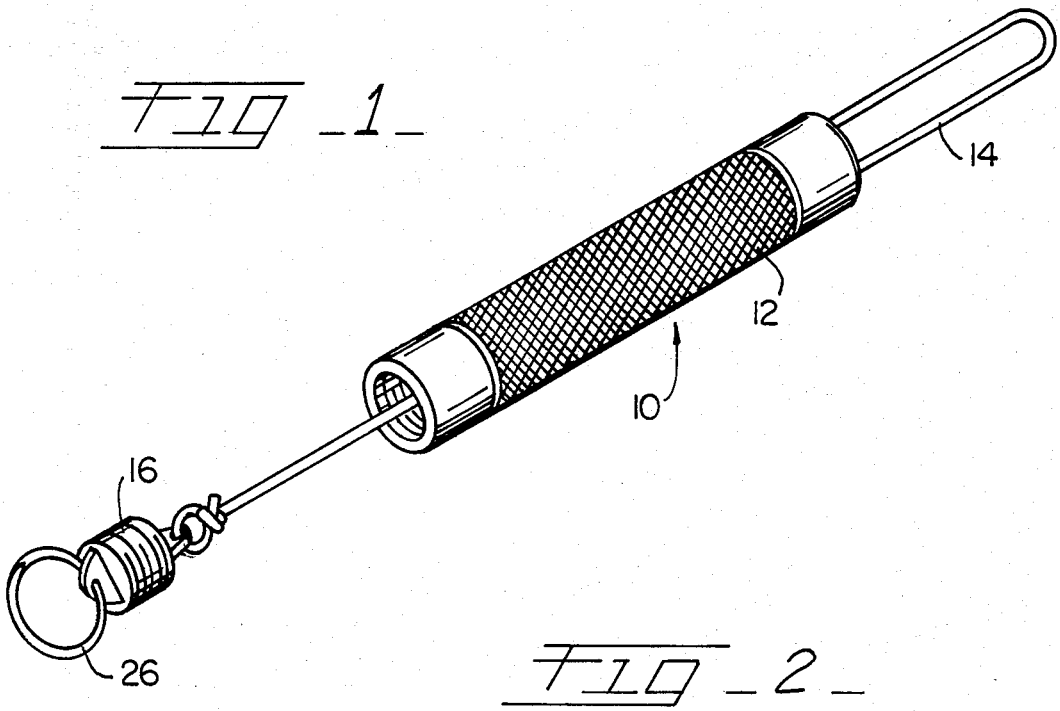
FIG. 2
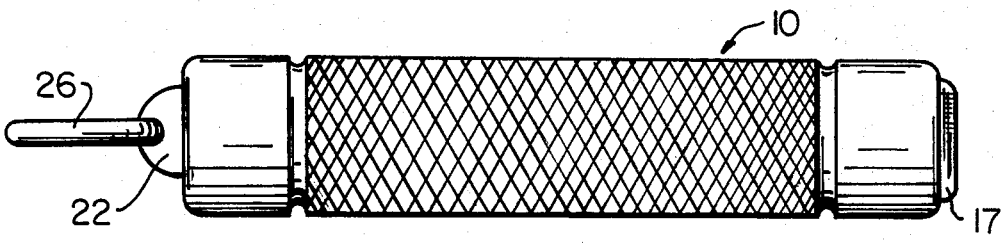
FIG. 4
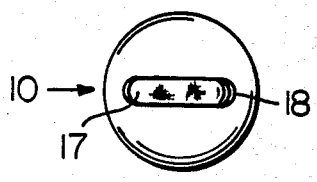
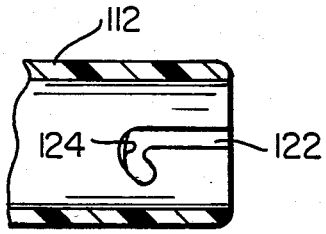
FIG. 10
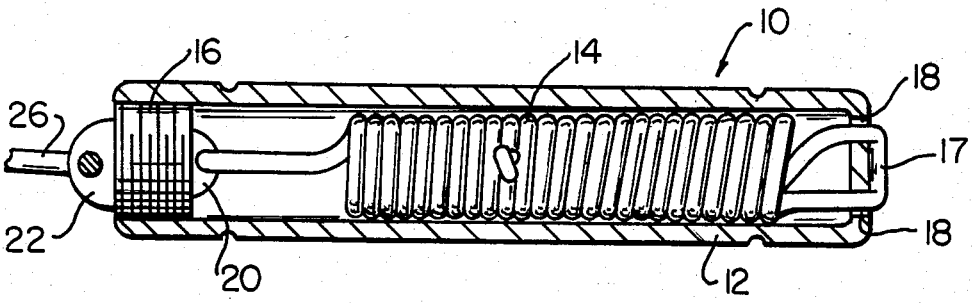
FIG. 3

PROTECTIVE DEVICE

FIELD OF THE INVENTION

The present invention relates to protective devices.

BACKGROUND OF THE INVENTION

There are several types of hand weapons which are known for self defense and other purposes. Police Departments, Military, Paramilitary units and practioners in the Martial Arts have devised several types of weaponry. Many of these weapons, however, are illegal for civilian use.

Various types of hand held clubs and flexible striking implements have been proposed. Because of their size, the concealability of the majority of such heretofore known weapons is poor. Those which are concealable, offer but marginal safety and reliability against an attacker. Many of such weapons require extensive training to acquire an average proficiency and control. With most of the heretofore known weapons, if the attacker is able to gain control of the weapon, such weapon may be used as a tool against the defender.

Therefore, it is desirable to have a hand held defensive tool that is small and can be easily concealed. At the same time, the desirable device should be legal, versatile in its self defense abilities, reliable, safe if removed from the defender during a struggle, and controllable.

SUMMARY OF THE INVENTION

In view of the above, and in accordance with the present invention, there is provided a protective device which satisfies the above requirements. The present invention is not a weapon in the traditional sense. Nothing in its component parts is inherently useful to inflict lethal injury to a determinbd adversary. Accordingly, the present invention is legal for a civilian to possess and carry on their person. The compact design of the present invention makes it easily concealable. Its design is the most humane possible that can realistically protect its user. One distinction between the present invention any other stick, knife, or firearm is that these latter weapons can only work if the user is fortunate, highly skilled, or through the inherent lethality of their construction. Instead of the defender determining the level of punishment, the weapons described above determine the level of punishment. There is no control once the decision is made to use such weapons. In contrast, the present invention inflicts only what the defender intends. It is a device of "escalation." That is, the defender selects which tactic and what level of punishment is necessary to stop the attacker. Moreover, the present invention is uniquely capable of performing all six defensive tactics, i.e., striking, blocking, pressure application, bone locking, strangulation and throwing. Apart from its simplicity and defensive efficiency, safety of the present invention is of prime importance. If lost or taken in a struggle, an adversary would not be able to effectively use the present device against the defender without first having a specific understanding of its operation.

The protective device of the present invention includes an elongated hollow handle, a closed loop member that is interlooped with one end of said handle and is distendable therefrom by the user and a releasable closure means disposed at the other end of the handle for withdrawing the distended loop. A detachable key ring or other suitable means may be operatively associated with the closure means for facilitating removal of the closure from the handle. The housing or handle may be made of metal or high impact plastic and is of a generally uniform diameter. The device measures approximately 5" in length and, thus, can be easily carried in a pocket or in one hand. A hand protective element may also be provided to protect the user.

In line with the above, a primary object of this invention is to provide a new and improved hand held protective device.

It is another object of this invention to provide a unique protective device that may be substantially concealed.

Yet another object of this invention is the provision of a defensive tool which permits the disablement of an attacker without deadly force.

Still another object of the present invention is the provision of a device by which the user controls the extent of punishment defensively inflicted upon an attacker.

Yet another object of the present invention is to provide a hand held defensive tool that may be used to protect the user against an attacker's thrusts, kicks, punches, grabs while simultaneously disabling the attacker.

BRIEF DESCRIPTION OF THE DRAWINGS

Having in mind the above objects and other attendant advantages that would be evident from an understanding of this disclosure, the invention comprises the devices, combinations, and arrangement of parts as illustrated in the presently preferred form of the invention which is hereinafter set forth in detail to enable those skilled in the art to readily understand the function, operation, construction and advantages of same when read in conjunction with the accompanying drawings in which:

FIG. 1 is a perspective view of one embodiment of the present invention;

FIG. 2 is a side view of the present invention;

FIG. 3 is a sectional view of the present invention;

FIG. 4 is a right side end view of the present invention;

FIG. 10 is a sectional view taken along line 10—10 of FIG. 6;

DETAILED DESCRIPTION OF THE PRESENT INVENTION

Figure 5:
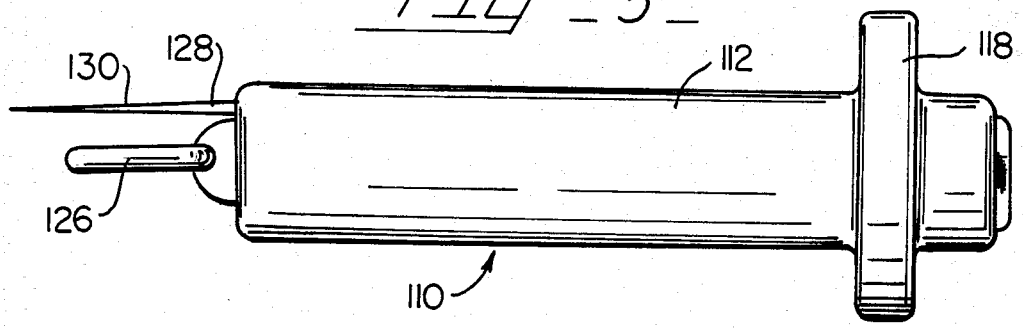
FIG. 5 is a side view of a second embodiment of the present invention.
Figure 7:
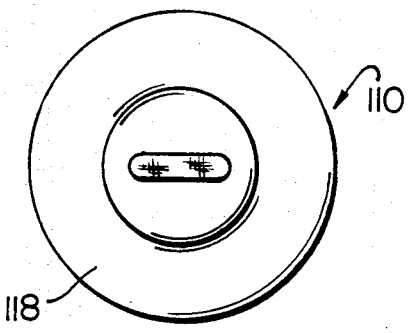
FIG. 7 is a right side view of the device shown in FIG. 5.
Figure 11:
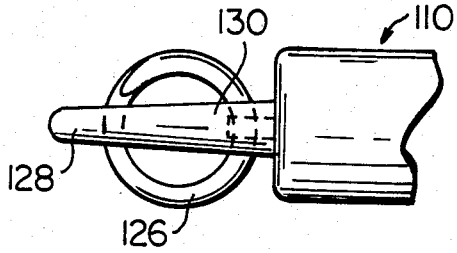
FIG. 11 is a top plan view of one end of the second embodiment.
Figure 6:
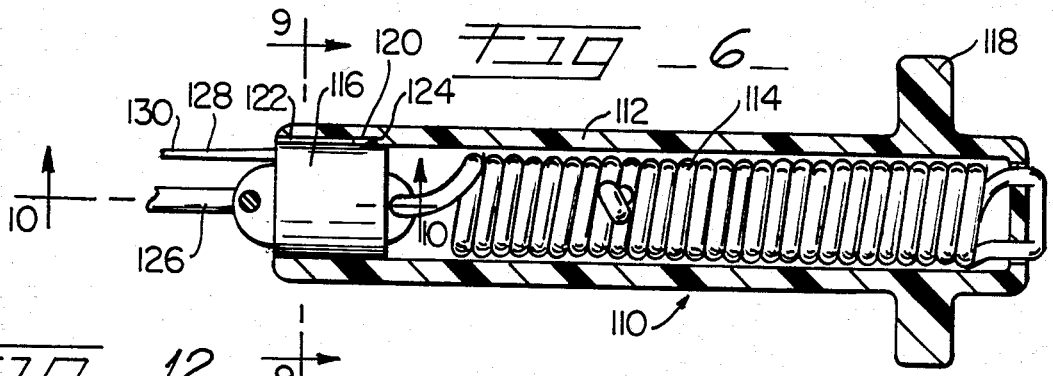
FIG. 6 is a sectional view of the device shown in FIG. 5.
Figure 12:
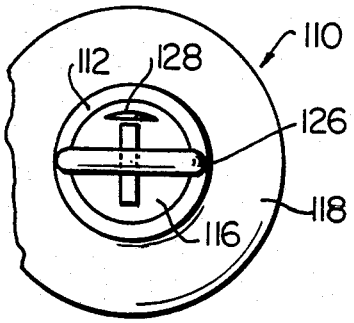
FIG. 12 is a left side end view of the device.
Figure 8:
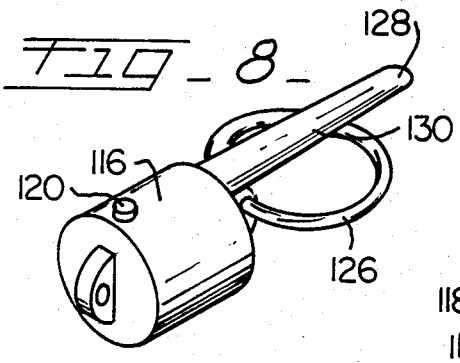
FIG. 8 is a perspective view of the releasable closure means of the second embodiment.
Figure 9:
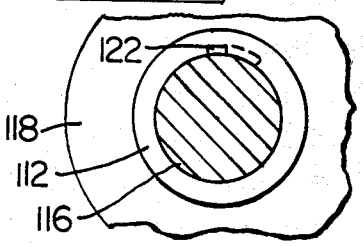
FIG. 9 is a sectional view taken along line 9—9 of FIG. 6.

Turning now to the drawings, in FIGS. 1 through 4, there is illustrated a protective device 10 according to the present invention. As best seen in FIG. 1, one embodiment of the device includes an elongated metal housing means 12 having a closed loop member 14 extendable from one end thereof and a releasable closure means 16 arranged at its other end. The device of the present invention is usually carried in the manner shown in FIG. 2 where only the bight portion 17 of the closed loop member extends beyond the housing.

The elongated cylindrical housing or handle 12, as best seen in FIGS. 3 and 4, is preferably of circular cross section and is hollow. By such construction, the housing or handle is capable of storing a fully collapsed major portion of the flexible element or closed loop with only a bight portion of the loop extending outside the handle. Preferably, the handle 12 has a diameter of approximately 1¼" (31.75 mm) and is approximately 5" (127 mm) in length. If desired, knurling, grooving or other grasp enhancing surface means may be provided on the exterior of the handle.

At one end of the housing, the closed loop is interlooped with the housing. To accomplish this end, the housing is apertured as at 18. Each of the apertures are suitably sized to permit the ready passage of the strands of the loop member 14 to pass therethrough. One strand of cable is passed through each of the aperatures. One end of the strand is adjustably secured as by knotting or other suitable ways to the other strand whereby forming a closed loop. In such manner, the size of the loop may be adjusted to the user of the device. Preferably, the length of the loop should correspond to the length of the user's forearm. The end of the other cable strand is operatively connected to the closure means 16. A straight pin or other suitably securing means secured proximate the end of the housing and interlooped or interlaced with the closed loop would serve the same function. Suffice it to say, closed loop 14 is interlooped with the handle in a manner whereby the looped member is prevented from becoming disassociated with the handle means of the protective device.

At its other end, the handle 12 is provided with the releasable closure means 16. In the first embodiment, the closure means 16 is threadably associated with the housing 12. At each of its ends, the closure is provided with apertured projections 20 and 22 extending in opposite longitudinal directions. As discussed above, the projection 20 is operatively connected to the looped member 14 via an extended strand of the loop member 14. The other projection 22 may have a removable key ring 26 or other suitable means associated therewith. The ring may facilitate removal of the concealable closure member from the handle means and also provides a means for securing the protective device onto a variety of belt keyring hangers.

Another embodiment of a protective device 110 is illustrated in FIGS. 5 through 10. In this embodiment, the device comprises an elongated, plastic housing or handle 112, a closed loop 114 interlooped with one end of said handle and having a releasable loop take up member 116 arranged at the other end of the handle. As seen in the drawings, the closed loop 114 has substantially the same interlooped relationship with the housing 112 as did the closed loop in the first embodiment. In the second embodiment, the handle is formed of a high impact plastic material. Moreover, the handle is formed with a hand protector element 118. Such element is preferably formed as an intergral part of the hollow housing 112. The element 118 includes an annular projection radially extending outward from the handle. Alternatively, the protection element may be formed as a separate piece. With either design, such hand protector is preferably disposed at the end of the handle opposite the loop retracting or take up means 116.

The loop retracting take up means 116 will now be described. The retractive means 116 is a pressure type means arranged to close the open end of the housing 112. The take up means 116 is operatively connected to the closed loop member in the same general manner as was the cable 14 with closure means 16. The take up or loop retraction means 116 is also operatively connected to the handle means through a pressure type connection. To accomplish this end, and as best seen in FIGS. 6 and 8 through 10, the closure means 116 is provided with a projection or pin 120 which fits into an J-shaped groove 122 formed in the housing. When assembling the protective device 110, the closure member is pressed and rotated in the cylindrical handle 112 against a spring biased member 124. This type of pressure type connection is much the same as employed by the automobile industry in the socket which is provided for the lamp on a tail light. To facilitate removal of the take up means 116 from the handle, a key ring 126 may be provided.

As shown, the closure means may be further provided with a protective instrumentality or knife means 128. The knife means 128 may include a cantilevered blade portion 130 whose mounted end is secured in the closure member 116. When the protective device 110 is in its assembled state, the knife means projects from the closure means 116 in a generally longitudinal direction away from the housing.

Figure 13:
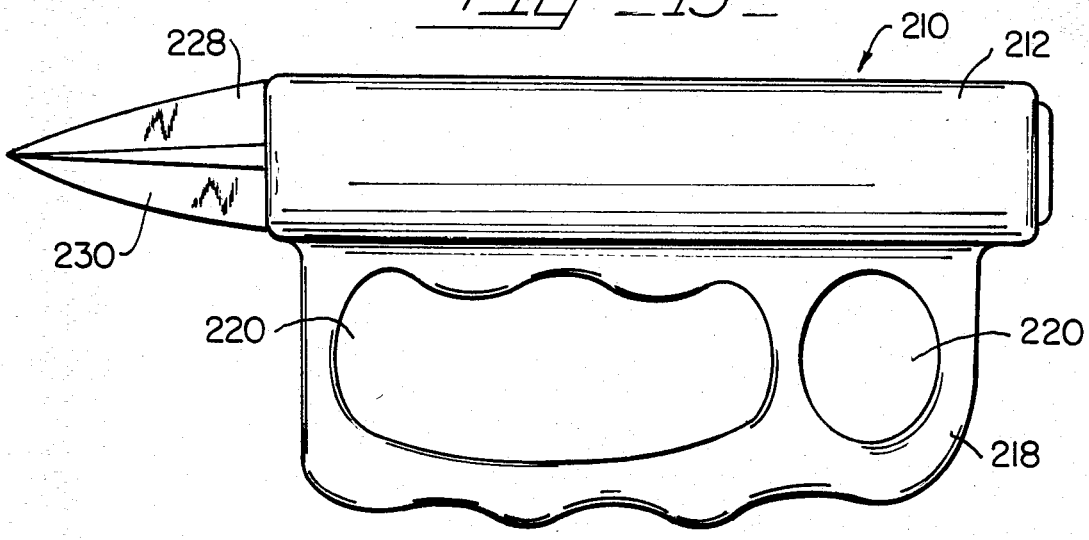
FIGS. 13 through 17 illustrate various views of a third embodiment of the present invention.
Figure 14:
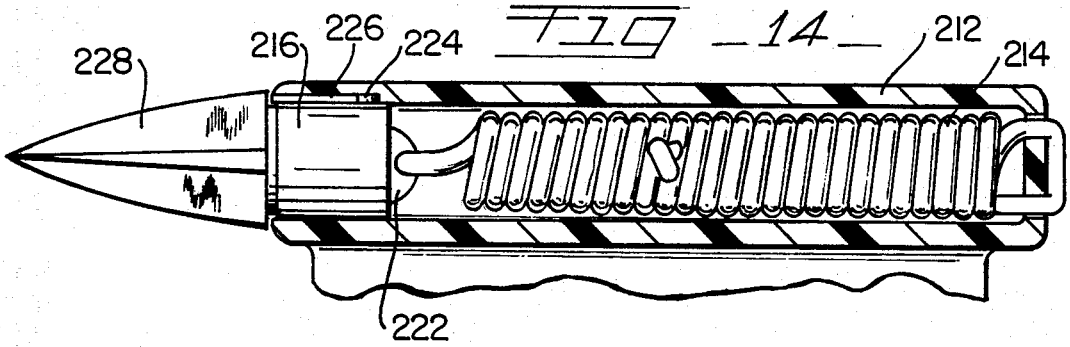
Figure 17:
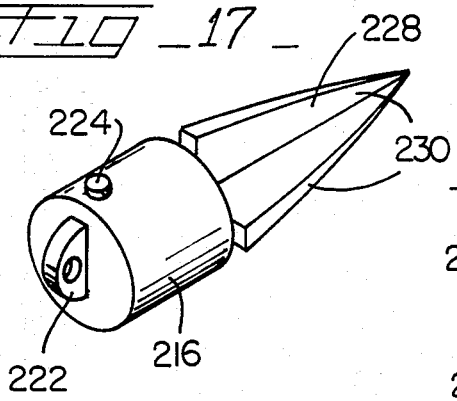
Figure 15:
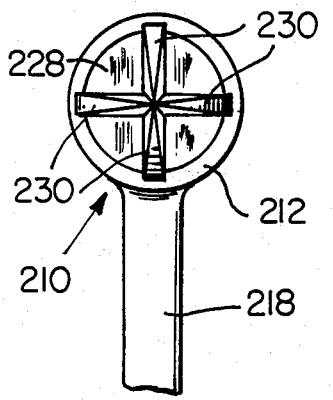
Figure 16:
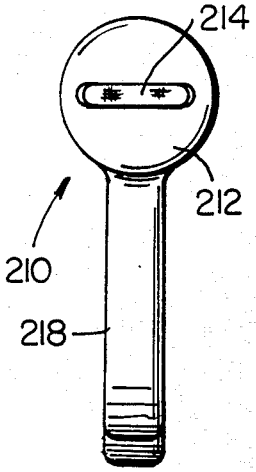

A third embodiment of a protective device 210 is illustrated in FIGS. 13 through 17. In this embodiment, the device 210 comprises a plastic handle or housing 212, a closed loop member 214 slidably interconnected or interlooped with the housing, and a plastic closure member 216 arranged at one end of the handle 212. As with the other embodiments, when the protective device is being carried, the majority portion of the loop member is arranged in the hollow housing with but a grasping or bight portion of the flexible member extending outside the housing. As seen in FIG. 14, the closed loop member has substantially the same interlaced relationship with the housing 212 as in the other two embodiments. As with the second embodiment, the handle 212 is formed with high impact plastic material. Additionally, the handle is formed with an outwardly projecting hand protector element 218. Such element is preferably formed with an integral part of the housing. The hand protector element is preferably provided with two or more apertures 220 disposed in a side-by-side relationship relative each other which act as grasping means permitting the user's fingers to pass through the element 218 to firmly grasp and hold the handle.

The closure means 216 of this third design is a pressure type means arranged to close the open end of the housing. As with the other embodiments, the closure means is operatively secured to the loop member through the extension of one strand of the loop member being secured to a projection 222 provided on the closure member.

The means for releasably securing the closure means to the housing are substantially the same as that used in the second embodiment. That is, a pin or projection 224 that fits into an appropriately formed slot 226 and is biased against the action of a resilient member.

To facilitate removal of the closure member 216 from the housing, a projection 228 longitudinally extends from the member 216. The projection may be formed as a protective element or knife means having one or a plurality of blade portions 230. The blade portions may take any shape, that illustrated being for descriptive purposes only.

Figure 18:
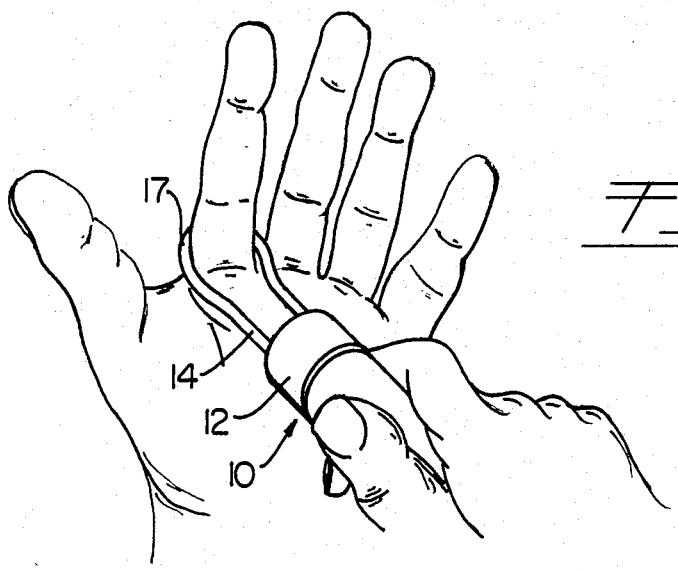
FIGS. 18 and 19 illustrate distension of the closed loop member from the handle.
Figure 19:
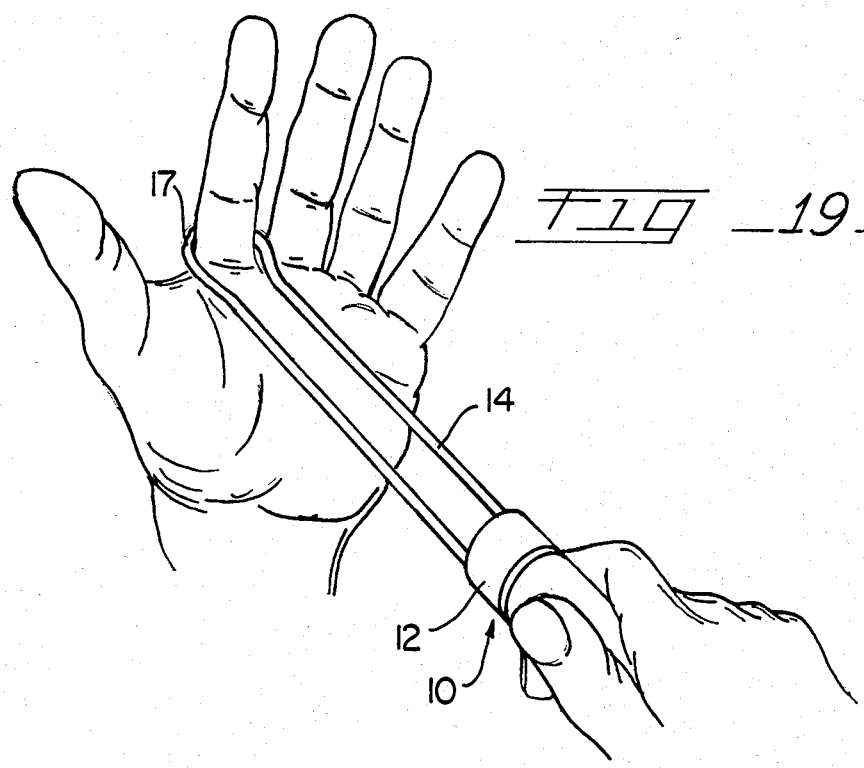

The operation of the protective device will now be described. Because the mode of operation of the several illustrated embodiments is substantially the same, the operation of the protective device 10 will be exemplary. As best seen in FIGS. 18 and 19, the looped member 14 may be quickly and simply distended to its full length from its holder or handle 12. To accomplish this end, the handle 12 of the device is grasped in one hand. As shown in FIG. 13, the operator then inserts any finger of the other hand through the exposed bight portion 17 of the closed loop member. The strands of the loop may then be distended from the housing by pulling the bight portion of the loop away from the handle means 12 whereby the strands of the loop extend outwardly from the housing in a generally parallel orientation relative to each other. The loop member may be extended until the closed loop reaches its extreme limit. That is, until the opposite bight portion of the loop contacts the apertured end of the housing thus preventing further unraveling of the looped member.

The length of loop spanning the distance between the handle of the device and the other hand held or secured end of the loop member may be used in a defensive bodily protective manner. That is, the distended loop may be used to defensively block an offensive blow or may be used to entrap an attacker's arm or limb.

After using the device, the extended loop member may be readily retracted and housed within the handle means 12. To accomplish this end, the operator would release closure means 16 from its operative association with the housing 12. Such action may be facilitated through the ring 26. While holding the handle 12, the operator would pull on the closure member 16 in a retracting direction away from the handle 12. Because the looped member is operatively connected to the closure member, the retracting movement of the closure member accordingly retracts the looped member into the housing or handle 12. The retraction of the loop continues until the bight portion 17 of the loop engages the apertured end of the housing. That portion of the loop or cable extending from the opposite end may be merely packed or coiled inside the handle by the operator and the releasable closure is again releasably secured to the handle awaiting further use. Moreover, it is within the scope of this invention to provide means for automatically withdrawing or retracting the distended loop member into the handle upon completion of use.

Thus it is apparent that there has been provided in accordance with the invention, a Protective Device that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described my invention, what I claim is:

1. A device used for bodily protection against another, said device comprising:

a hollow cylindrical housing means;

a closed loop member whose strands are interlooped with said housing means at one end thereof and having an engaging portion which the user engages to distend the member from the housing in a form such that the strands extend outwardly from said housing means in a generally parallel orientation relative to each other for defensive use; and releasable closure means arranged at the other end of said housing means and being operatively connected to said loop member.

2. The protective device of claim 1 wherein said housing means is metal.

3. The protective device of claim 1 wherein said housing means is plastic.

4. The protective device of claim 1 wherein said housing means generally measures $1\frac{1}{4}''$ (31.75 mm) in diameter.

5. The protective device of claim 1 wherein said housing means is of a substantially uniform diameter.

6. The protective device according to claim 1 wherein said housing means generally measures 5" (127 mm) in length.

7. The protective device of claim 1 wherein said releasable closure means includes means for facilitating removal of said closure means from said housing means.

8. The protective device according to claim 1 wherein said closure means is threadably secured to said housing means.

9. The protective device according to claim 1 wherein said closure means is releasably press fit into said housing means.

10. A self defense device comprising:

an elongated hollow handle means having a flexible closed loop member whose strands are interlooped with one end thereof in a manner permitting limited distention of said loop member, said handle means being capable of storing a fully collapsed majority portion of said closed loop member therein with a bight portion of theloop member extending outside of the handle means so as to be engaged by the user in distending the loop from the handle such that the strands are generally parallel and disposed for defensive use; and a loop take up member operatively associated with the loop member and releasably secured to the other end of said handle means.

11. The protective device of claim 10 wherein the size of said loop member is adjustable.

12. The protective device of claim 10 wherein said closed loop member is in the form of a rope.

13. The protective device of claim 10 wherein said closed loop member is in the form of a cable.

14. The protective device of claim 10 wherein a knife means is provided in combination with the takeup member.

15. The protective device according to claim 10 wherein a hand protective element is formed as part of said handle means.

16. The protective device according to claim 15 wherein said hand protective element includes an annular projection radially extending from said handle means.

17. The protective device according to claim 10 wherein said hollow handle means has a substantially circular cross section.

18. The protective device according to claim 10 wherein said loop take up member includes means for facilitating removal of said member from said handle means.

19. A hand held self defense weapon comprising:

an elongated hollow handle;

a closed loop member normally stored in the interior of the handle with a portion of said member being exposed so as to be engaged by the user when the loop member is distended from the handle;

means interlaced with strands of said loop member and arranged at one end of said handle means for preventing the loop member from becoming disassociated with the handle means when the loop is distended whereby the handle means and the strands of said loop member are defensively used in combination; and loop retraction means operatively connected to the loop member and releasably secured to the other end of said handle means.

20. A method of self protection comprising the steps of:

providing a weapon having a hollow handle and a closed loop member whose strands are stored therein and interlooped therewith;

holding said handle in one hand;

grasping an exposed bight portion of the closed loop member with the other hand and distending the closed loop member such that the strands thereof extend outwardly from said handle means in a generally parallel orientation relative to each other and to the extent permitted by the size of the closed loop member; and using the parallel strands of loop extending between said bight portion and said handle in a defensive manner.

21. The protective device according to claim 15 wherein the hand protective element is provided with at least two side by side disposed finger openings.

22. A self defense weapon comprising:

a hollow handle means;

an elongated flexible member normally stored in the interior of said handle means with a portion thereof being exposed so as to be grasped by the user, said flexible member being slidably fixed to one end of said handle means in a manner permitting limited distention thereof by the user for defensive use; and retraction means operatively connected with said flexible member and releasably secured in a concealed manner to the other end of said handle means.

23. A self defense weapon comprising:

a hollow handle means;

an elongated flexible element slidably interconnected with one end of said handle means and normally stored in the interior of said handle means with a portion thereof being exposed whereby the flexible element may be distended from said handle means a limited distance by the user in a defensive manuever; and releasable closure means concealably arranged at the other end of said handle means and operatively connected to said flexible element.

* * * * *